United States Patent [19]

Roberson et al.

[11] 4,400,313

[45] Aug. 23, 1983

[54] PROCESS FOR WASTE ENCAPSULATION

[75] Inventors: Keith Roberson, Freeland; Harold E. Filter, Midland, both of Mich.

[73] Assignee: The Dow Chemical Company, Midland, Mich.

[21] Appl. No.: 164,424

[22] Filed: Jun. 30, 1980

[51] Int. Cl.[3] ..... G21F 9/16

[52] U.S. Cl. ..... 252/628; 525/112; 525/117; 525/119; 525/170

[58] Field of Search ..... 252/301.1 W; 525/170, 525/112, 117, 119

[56] References Cited

U.S. PATENT DOCUMENTS

| | | | |
|---|---|---|---|
| 2,378,629 | 6/1945 | Hanford . | |
| 3,066,122 | 11/1962 | Bowen . | |
| 3,179,623 | 4/1965 | Bowen . | |
| 3,190,868 | 6/1965 | Mitzcek . | |
| 3,256,226 | 6/1966 | Fekete . | |
| 3,301,743 | 1/1967 | Fekete . | |
| 3,367,992 | 2/1968 | Bearden . | |
| 3,705,124 | 12/1972 | Selby et al. | 260/29.6 |
| 4,077,901 | 3/1978 | Arnold et al. | 252/301.1 |
| 4,097,449 | 6/1978 | Heilman et al. | 525/112 |

FOREIGN PATENT DOCUMENTS 1418277 12/1975 United Kingdom .

OTHER PUBLICATIONS

"Surface Active Agents", Mar. 15, 1963; published by Rohm & Haas Company.

"Tamol Dispersants", not dated, published by Rohm & Haas Company.

*Primary Examiner*—Deborah L. Kyle

*Attorney, Agent, or Firm*—B. M. Kanuch

[57] ABSTRACT

An improvement in the process of encapsulating waste materials in aqueous liquid or finely divided, dry solid form, in liquid thermosettable resins of the group consisting of vinyl ester resins, unsaturated polyester resins, and mixtures thereof, which comprises increasing the amount of waste material incorporated in a given amount of resin by adding thereto a water-soluble polymeric substance containing a carbon chain having a plurality of —COOH groups or derivatives thereof.

13 Claims, No Drawings

PROCESS FOR WASTE ENCAPSULATION

BACKGROUND OF THE INVENTION

A major environmental problem centers around the disposal of various waste materials. These include radioactive wastes from nuclear fission processes, and particularly low level wastes such as those obtained from the aqueous evaporators in a nuclear power plant, used ion-exchange resins and filter materials such as clays and charcoal. These wastes may be in the form of finely divided, dry solids or aqueous solutions, dispersions or slurries. Other problem wastes are those obtained as by-products from various chemical operations, such as electroplating solutions, by-products from insecticide manufacturing plants, and the like.

One method of disposing of these wastes is to incorporate them in materials such as cement or urea formaldehyde resins, solidifying the mixture and burying the blocks thus made in approved burial sites. Some of the shortcomings of this particular process are described in U.S. Pat. No. 4,077,901. This same patent describes one solution which has proven to be quite satisfactory, namely, the encapsulation of these waste materials in vinyl ester resins or in unsaturated polyester resins or in mixtures of these two types of resins. British Pat. No. 1,418,277 also describes incorporating solid radioactive wastes in a resin copolymerized with a monomer to form a solid block.

The problem of waste disposal has intensified due to the rising costs of the incorporating materials, extreme difficulty in obtaining burial space, and the criticality of effecting uniform encapsulation of radioactive waste materials so as to avoid hot spots which lead to increased transportation and burial costs of such encapsulated wastes.

THE INVENTION

The present invention is an improvement in the encapsulation of aqueous, liquid or finely divided, dry solid waste materials in liquid thermosettable resins of the group consisting of vinyl ester resins, unsaturated polyester resins or mixture of these resins. This improvement comprises the addition, during the encapsulation process, of a water-soluble polymeric substance containing a carbon chain having a plurality of —COOH groups or derivatives thereof. The purpose of adding the water soluble polymeric substance is to increase the amount of waste material encapsulated in a given amount of resin.

This encapsulation process is described in U.S. Pat. No. 4,077,901 and comprises the uniform dispersion of the waste material in the liquid thermosettable resin. The water-soluble polymeric substance may be added to the waste material or to the liquid thermosettable resin prior to forming the waste-resin dispersion or may be added to the waste-resin dispersion during or after the formation thereof. The addition of the water-soluble polymeric substance increases the amount of waste material which can be dispersed in the liquid thermosettable resin and, consequently, the amount of waste encapsulated in such resins when the dispersion is gelled and hardened or cured.

DESCRIPTION OF THE INVENTION

The present invention is an improvement in the process described in detail in U.S. Pat. No. 4,077,901, the disclosure of which is fully incorporated herein by reference. The process of said patent broadly comprises the making of waste material-resin dispersions by blending resins, as defined in the patent, with both solid wastes and aqueous liquid wastes. The resins used in the process are liquid thermosettable resins which include vinyl ester resins, unsaturated polyester resins and mixtures of these resins. The vinyl ester resins that may be employed are more particularly defined in the claims as liquid thermosettable resin compositions of (1) a vinyl ester resin prepared by reacting about equivalent proportions of an unsaturated monocarboxylic acid and a polyepoxide resin, said vinyl ester resin containing

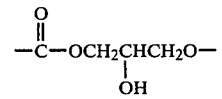

linkage groups and terminal vinylidene groups attached to the ester end of said linkage or (2) an unsaturated polyester or (3) mixtures thereof, and a catalyst for curing said resin. When aqueous wastes are involved, the composition is cured under thermal and catalytic conditions such that the exotherm developed during the cure never rises above the temperature at which the integrity of the encapsulating material is destroyed (e.g., 100° C.). Vinyl ester resins are further described in U.S. Pat. Nos. 3,367,992; 3,066,112; 3,179,623; 3,301,743; and 3,256,226.

Preferably, the thermosettable resin phase comprises from 40 to 70 weight percent of the vinyl ester or polyester resin and from 60 to 30 percent of a copolymerizable monomer. Suitable monomers must be essentially water insoluble to maintain the monomer in the resin phase in the emulsion, although complete water insolubility is not required and a small amount of monomer dissolved in the emulsified water does no harm.

Suitable monomers include vinyl aromatic compounds such as styrene, vinyl toluene, divinyl benzene, and the like, and the saturated alcohols such as methyl, ethyl, isopropyl, octyl, etc., esters of acrylic acid or methacrylic acid; vinyl acetate; diallyl maleate; dimethallyl fumarate; mixtures of the same and all other monomers which are capable of copolymerizing with the vinyl ester resin and are essentially water insoluble.

Still another group of vinyl ester resins that may be employed are those modified by reaction with dicarboxylic acid anhydrides.

The unsaturated polyester resins that may be used in the process are described in column 3 of U.S. Pat. No. 4,077,901. Such polyesters are made by reacting ethylenically unsaturated dicarboxylic acids or anhydrides with an alkylene glycol or polyalkylene glycol having a molecular weight of up to about 2,000.

Mixtures of the vinyl ester and the unsaturated polyester resins may be employed.

In practicing the method of the invention covered by U.S. Pat. No. 4,077,901, a free radical yielding catalyst is blended with the resin and the waste material is then dispersed in the resin under conditions to form a uniform dispersion. When the waste is a solid, it should be finely divided. When the waste is an aqueous liquid, a liquid waste-in-resin emulsion if formed. In such instances, the liquid waste is added to the liquid, uncured resin under shearing conditions to form the emulsion. While the shear conditions may be widely varied, generally with aqueous liquid wastes, sufficient shear should be applied to produce a relatively uniform emulsion of small droplet size. The dispersion, whether of liquid or solid disperse phase, should have sufficient storage stability to last at least through the initial gelation of the resin. The dispersions made with the vinyl ester resins, particularly those previously described, generally exhibit adequate stability without added emulsifier. Emulsions made with unsaturated polyester resins frequently will require added emulsifier. Such emulsifiers are known in the art, and judicious selection can be made with simple routine experiments.

Catalysts that may be used for the curing or polymerization are preferably the peroxide and hydroperoxide catalysts such as benzoyl peroxide, lauroyl peroxide, t-butyl hydroperoxide, methyl ethyl ketone peroxide, t-butyl perbenzoate, potassium persulfate and the like. The amount of catalyst added will vary preferably from 0.1 to about 5 percent by weight of the resin phase. Additional catalyst may be required for certain wastes.

Preferably, the cure of the emulsion can be initiated at room temperature by the addition of known accelerating agents or promoters, such as lead or cobalt naphthenate, dimethyl aniline, N,N-dimethyl-P-toluidine and the like, usually in concentrations ranging from 0.1 to 5.0 weight percent. The promoted emulsion can be readily gelled in about 3 to 15 minutes, depending on the temperature, the catalyst level and the promoter level; and cured to a hard solid in about one hour.

It is important that when aqueous liquid wastes are involved, the conditions of selection of catalyst, catalyst concentration and promoter selection and concentration be such that the exotherm does not rise above the temperature at which the integrity of the encapsulating material will be destroyed.

The improvement of the present invention resides in the discovery that the addition of certain water-soluble polymeric substances (sometimes referred to herein as "extenders") during the encapsulation process above described, substantially increases the amount of waste that can be encapsulated in a given amount of resin. The extenders comprising the present invention broadly encompass those water-soluble polymeric substances which contain a carbon chain having a plurality of —COOH groups, and derivatives thereof. These extenders and methods of making same are described in detail in U.S. Pat. No. 3,190,868.

Preferably, the extenders comprising the present invention are anionic compounds having a low acid functionality. The molecular weights of these polymers as determined by the Rast Method may vary from 500 to 10,000, although lower molecular weights in the order of 800 to 3,000 are preferred. Optimum results have been obtained with water-soluble copolymers of a 1-olefin containing 4 to 16 carbon atoms and a compound selected from the group consisting of

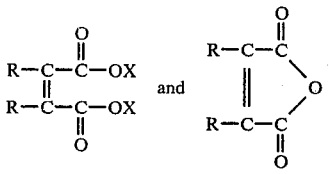

where each R is individually selected from the group consisting of hydrogen, methyl and ethyl and X is individually selected from the group consisting of hydrogen, methyl, ethyl, propyl, butyl, ammonium and alkali metal. The preferred 1-olefins are those containing 6 to 10 carbon atoms, and diisobutylene has been found to produce particularly effective extenders.

Carboxyl containing compounds having the generic formula of the anhydrides shown above are preferred in the production of extenders for use in the present invention, and particularly maleic anhydride. As noted in U.S. Pat. No. 3,190,868, copolymers of diisobutylene and maleic anhydride are well known in the art, and are also disclosed and described in U.S. Pat. No. 2,378,629. Particularly outstanding results have been achieved in the practice of the present invention with the use of extenders which comprise a copolymer of diisobutylene and maleic anhydride in approximately equal proportions and having a molecular weight of about 1,500. This material, in the form of the sodium salt is available commercially under the trademark "TAMOL-731", a product of the Rohm and Haas Company; and in the form of the ammonium salt, as "TAMOL-165", which is of slightly higher molecular weight than "TAMOL-731". DAXAD-31, a trademark product commercially available from W. R. Grace is essentially similar to the above.

In practicing the improved process comprising this invention, the water-soluble polymeric substance or extender may be incorporated in the waste or in the resin prior to forming the waste-resin dispersion. With most waste materials tested, the addition of the extender to the resin phase produces more uniform dispersions and better encapsulation. The extender is normally not soluble in the resin phase, so that the addition of the extender to the resin must be accomplished along with sufficient stirring to obtain a uniform dispersion of the extender throughout the resin. When the extender is to be incorporated in the waste-resin dispersion, it may be added at any point during the mixing of the two phases of the dispersion, and may be introduced in small increments or all at one time. Normally, the extender will be added in water solution to insure complete dispersion in the system.

In making verification or test runs to determine optimum amounts of extender and appropriate ratios of aqueous liquid waste to resin, it may be advantageous to add the extender in small increments using the water streak end point hereinafter described. Dispersions made of aqueous liquid waste materials and resins are usually of a creamy consistency. When the amount of waste added exceeds the ability of the resin to incorporate the waste in the dispersion, this produces water streaks which swirl about the vortex created by the stirrer. These streaks are of a different consistency from the rest of the dispersion and sometimes of a different color. When the water-soluble polymeric substance is added to the dispersion at the point when these water streaks first appear, the streaks will disappear upon further stirring and additional waste material may be incorporated in the dispersion (when the water streaks reappear, additional extender is incorporated until the streaks disappear). This step-by-step procedure can be continued until the maximum amount of waste that a given amount of resin can encapsulate has been reached. This water streak end point is of considerable significance, since dispersions of waste and resin which contain water streaks usually produce a hardened encapsulated product which has free water on its surface. Such a product is not acceptable for burial.

When finely divided dry solids are to be incorporated in the resin phase, the extender should first be added to the resin before mixing in the finely divided solids. The end point that is used in practical applications with solid wastes is that point where the dispersion of solids in resin moves with the stirrer in such a manner that additional stirring does not achieve additional dispersion.

It should be noted that the addition of water-soluble polymeric substances to the waste-resin dispersion does not adversely affect the amount of catalyst or promotor that is required for effective cure of the resin, nor does it adversely affect the exothermic temperature produced during such cure beyond that which one skilled in the art can easily make appropriate adjustments.

The amount of extender (based on dry weight) employed generally in encapsulating aqueous wastes ranges from 0.06 to 8.0 percent by weight based on the weight of the resin, with the preferred range being from 0.2 to 5.0 percent. Solid wastes generally require somewhat less additive, ranging from 0.06 to 1.5 percent by weight based on the weight of the resin, with a preferred range of 0.1 to 0.8 percent.

The method of the present invention is illustrated in the following Examples taken together with certain "Comparative Runs" wherein all parts and percentages are by weight unless otherwise indicated, and where:

(1) *Resin A* is a fluid thermosettable resin which is prepared by reacting 32.6 parts of the diglycidyl ether of bisphenol A extended with 8.7 parts of bisphenol A; then reacted with 1.2 parts maleic anhydride and 7.5 parts methacrylic acid, the resin dissolved in 50 parts styrene.

(2) *Resin B* is a fluid thermosettable resin obtained from PPG Ind. Inc., under the trade designation Selectron SR-3704.

(3) *Catalyst* is 40 percent benzoyl peroxide emulsified in diisobutyl phthalate obtained from Noury Chemical Corp. under the trade designation Cadox 40E.

(4) Promoter is N,N-dimethyl-p-toluidine.

(5) *Extender* is 25 percent Tamol-731 in water.

COMPARATIVE RUN 1

A simulated waste slurry is prepared by mixing uniformly the following solids in the proportions shown in water:

| | |
|---|---|
| magnesium hydroxide | 22.5 grams |
| magnesium carbonate | 22.5 grams |
| water | 255.0 grams |
| | 300.0 grams |

Solidification is attempted using the following formulations, C.R.1A and C.R.1B, differing only in respect to the quantity of waste slurry added:

| Formulation | C.R. 1A | C.R. 1B |
|---|---|---|
| Resin A | 100.0 ml | 100.0 ml |
| Catalyst | 2.5 ml | 2.5 ml |
| Slurry | 69.5 gms | 200.0 gms |
| Promoter | 0.23 ml | 0.23 ml |

The catalyst is added to the Resin A and stirred until uniformly dispersed. The slurry is subsequently added to the mixture with rapid stirring to maintain a vortex in the center of the stirred mixture. Initial addition of the slurry produces a white water in oil emulsion which increases in viscosity as the slurry is added. After 69.5 grams of slurry is added, liquid (water) streaks are noted in the emulsion. Addition of the slurry is then discontinued and the promotor is added.

Following the addition of the promoter, the emulsion gels in about 6.5 minutes and reaches a peak temperature of 90° C. in about 1 hour producing a white hard block. The block is removed from its container and approximately 5 ml of free liquid is observed.

In respect to the formulation C.R.1B, the addition of the slurry is continued after the observation of water streaks in the emulsion, eventually causing the emulsion to invert, becoming very low in viscosity, like water, at which time the promoter is added. The formulation C.R.1B separates into two distinct phases: an oil or resin phase on the bottom and a water phase on top. The resin phase appears to gel after about 24 minutes and becomes warm to the touch. A solid block is not obtained however. After 24 hours, free water is still observed on the top and the bottom phase is a weak gel.

EXAMPLE 1

Using the simulated waste slurry of Comparative Run 1, the following formulations incorporating the extender are prepared:

| Formulation | Ex. 1A | Ex. 1B | Ex. 1C |
|---|---|---|---|
| Resin A | 100.0 ml | 100.0 ml | 100.0 ml |
| Catalyst | 2.5 ml | 2.5 ml | 2.5 ml |
| Extender | 6.0 ml | 6.0 ml | 10.0 ml |
| Slurry | 200.0 gms | 200.0 gms | 200.0 gms |
| Promoter | 0.23 ml | 0.23 ml | 0.23 ml |

Ex. 1A is prepared by adding the waste until water streaks form and thereafter incrementally adding extender to the emulsion in 2.0 ml increments. Such incremental additions are made after 61, 84 and 122 grams of the slurry are sequentially added. After the slurry addition is complete, the promoter is added and the emulsion stirred for 1 to 1.5 minutes. The emulsion gels in 3.25 minutes and reaches a peak temperature of 63° C. within one hour. A white, hard solid block is obtained with no free liquid being in visual evidence.

In Ex. 1B, the extender is added to the Resin A catalyst mixture in a single step, the conditions of this experiment being otherwise comparable to Ex. 1A. The waste slurry is subsequently added and a white viscous emulsion judged equal to that of Ex. 1A results. The promoter is then added and the emulsion stirred for 1 to 1.5 minutes. The emulsion gels in 4.5 minutes and reaches a peak temperature of 61.5° C. within one hour. A white, hard solid is obtained which shows no free liquid upon visual examination.

A total of 10.0 ml of extender is added to the waste slurry in Ex. 1C. This mixture is then added to the Resin A catalyst mixture in the same manner as in the other examples above and a white, viscous emulsion equivalent to that of Ex. 1A and Ex. 1B results. The promoter is subsequently added and the emulsion stirred for 1 to 1.5 minutes. The emulsion gels in 4.0 minutes and reaches a peak temperature of 63° C. within one hour. A white, hard solid in achieved again without evidence of free liquid when visually examined.

COMPARATIVE RUN 2/EXAMPLE 2

A simulated dry solid waste which is obtained from Aerojet Energy Conversion Co. is used in this experiment series, and consists of a sodium sulfate and ash mixture. The following Formulations C.R.2 (with no extender) and Ex. 2 (with the extender) are used:

| Formulation | C.R. 2 | Ex. 2 |
|---|---|---|
| Resin A | 100.0 ml | 100.0 ml |
| Catalyst | 2.5 ml | 2.5 ml |
| Extender | — | 1.0 ml |
| Dry Solid Waste | 250.0 gms | 250.0 gms |
| Promoter | 0.10 ml | 0.10 ml |

The materials are mixed in the order listed above. Mixing is done at high speed using an air stirrer.

Formulation C.R.2 forms an extremely viscous mixture in which it is difficult to add the last 30–35 grams of waste and the promoter. The mixture gels in 6.5 minutes and is rock hard in one hour. When removed from the container, however, voids or pockets are in evidence showing that the emulsion was too viscous to flow and level properly.

Formulation Ex. 2 is a repeat of C.R.2 using, however, extender which is added to the Resin A/catalyst mixture in the order indicated. Viscosity, while relatively high, is such that no particular problem is encountered in adding either waste or promoter to the mix. The resulting mixture gels in 5 minutes and is rock hard in one hour. When removed from the container, the waste is found to be dispersed uniformly in the block (no void formation being visually evident). The addition of the extender thus allows a greater amount of dry solids to be added to the mixture and still maintain an acceptable solidification product.

COMPARATIVE RUN 3/EXAMPLE 3

These experiments use the polyester Resin B. The waste used is a 1.0/1.0 weight mixture of powdered anion/cation ion exchange resin slurry. The slurry contains approximately 30 weight percent powdered ion exchange resin and the remainder water. The following formulations are used:

| Formulation | C.R. 3 | Ex. 3 |
|---|---|---|
| Resin B | 100.0 ml | 100.0 ml |
| Catalyst | 10.0 ml | 10.0 ml |
| Powdered Ion Exchange Resin Waste Slurry | 40 gms | 100.0 gms |
| Extender | — | 2.0 ml |

Formulation C.R.3, which is prepared without extender, produces a smooth, tan emulsion initially. Water streaks, however, appear in the emulsion after 40 grams of waste slurry are added.

Ex. 3 continues the experiment by adding additional waste slurry and introducing extender into the C.R.3 emulsion (after the water streaks appear). A smooth light tan emulsion is achieved demonstrating the beneficial effect of extender on the unacceptable C.R.3 product.

COMPARATIVE RUN 4/EXAMPLE 4

A powdered ion exchange resin slurry, as used in the preceding example, is used also in this example and comparative run, using the following formulations:

| Formulation | C.R. 4 | Ex. 4 |
|---|---|---|
| Resin A | 100.0 ml | 100.0 ml |
| Catalyst | 10.0 ml | 10.0 ml |
| Powdered Ion Exchange Resin Waste Slurry | 50 gms | 200.0 gms |
| Extender | — | 1.0 ml |

Formulation C.R.4 is prepared without extender and a smooth tan emulsion results when the waste is added initially. Water streaks, however, are noted when the full 50 grams of waste is added to the mixture.

Formulation Ex. 4 is prepared by adding 1.0 ml extender and additional waste slurry to the unsatifactory emulsion of C.R.4. The water streaks disappear upon the addition of the extender, and a smooth, tan emulsion results which increases in vicosity as further waste slurry is added.

COMPARATIVE RUN 5/EXAMPLE 5

The waste to be encapsulated in this experiment is a simulated radioactive waste of the following mixed ingredients:

| Ingredient | Amount |
|---|---|
| $Na_2SO_4$ | 20 grams |
| $MgSO_4$ | 20 grams |
| CH—50 | 50 grams |
| $HNO_3$ | 10 grams |
| Attapulgos clay | 10 grams |
| Water | 1000 grams |

Two formulations are used, specifically:

| Formulation | C.R. 5 | Ex. 5 |
|---|---|---|
| Resin A | 80.0 ml | 80.0 ml |
| Catalyst | 2.0 ml | 2.0 ml |
| Simulated Radioactive Waste | 35.0 ml | 120.0 ml |
| Extender | — | 5.0 ml |
| Promoter | 0.12 ml | 0.12 ml |

C.R.5 (which is prepared without extender) initially produces a smooth, white emulsion. Water streaks, however, are noted upon the addition of 35 ml of waste to the formulation.

Ex. 5 is prepared by adding 5.0 ml extender and additional waste slurry to the C.R.5 emulsion (after the appearance of water streaks). A smooth, white emulsion results which increases in viscosity as the full amount of waste is added to the emulsion. No water streaks are observed in the final product.

EXAMPLE 6

This experiment uses an actual radioactive waste believed to contain essentially the materials of the simulated waste of Example 5. The radioactive waste is encapsulated using the following formulation:

| Formulation | Amount |
|---|---|
| Resin A | 50.0 ml |
| Catalyst | 1.2 ml |
| Extender | 5.0 ml |
| Radioactive Waste | 25.0 ml |

-continued

| Formulation | Amount |
|---|---|
| Promoter | 0.08 ml |

The waste is encapsulated by combining the materials in the recited order. An excellent white emulsion is obtained which gels in 10 minutes and forms a hard white block in one hour. No free water is observed, upon visual examination of the final product.

By increasing the amount of waste that can be incorporated in a given amount of resin, as demonstrated by the preceding Examples, intended to be exemplary in nature and not limiting, the process of the present invention reduces the cost of the encapsulation process, since substantially less resin is required. Furthermore, the process of the invention reduces the volume of burial space required, a factor which is becoming more critical. The uniformity of the encapsulation of the waste material reduces the radioactive hot spots, thus making the product less expensive to transport and bury (since transportation and burial costs are based on maximum radioactivity at any point on the product), and also makes the product more acceptable to those persons operating approved burial sites.

What is claimed is:

1. In the process of encapsulating dry solids and aqueous wastes in liquid thermosettable resins of the group consisting of vinyl ester resins, unsaturated polyester resins and mixtures thereof, wherein the waste is dispersed in the resin, the improvement which comprises incorporating in the waste-resin dispersion a water-soluble copolymer of a 1-olefin containing 4 to 16 carbon atoms and a compound selected from the group consisting of

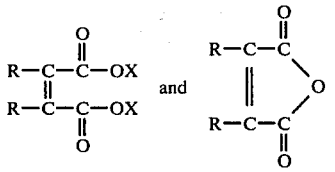

where each R is individually selected from the group consisting of hydrogen, methyl and ethyl and X is individually selected from the group consisting of hydrogen, methyl, ethyl, propyl, butyl, ammonium and an alkali metal, said copolymer being present in an amount sufficient to increase the amount of waste encapsulated in a given amount of resin.

2. The process of claim 1 wherein the compound selected from the group is

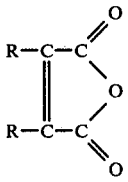

3. The process of claim 2 wherein R is the compound selected from the group is hydrogen.

4. The process of claim 3 wherein the 1-olefin is diisobutylene.

5. The process of claim 2 wherein the 1-olefin contains from 6 to 10 carbon atoms.

6. In the process of encapsulating aqueous liquid wastes in liquid thermosettable resins of the group consisting of vinyl ester resins, unsaturated polyester resins and mixtures thereof, wherein the liquid waste is dispersed in the resin, the improvement which comprises incorporating in the waste-resin dispersion a water-soluble copolymer of a 1-olefin containing 4 to 16 carbon atoms and an anhydride having the formula

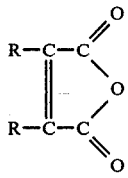

wherein each R is individually selected from the group consisting of hydrogen, methyl and ethyl, said copolymer having a molecular weight of from about 500 to 10,000, and is present in an amount sufficient to increase the amount of waste encapsulated in a given amount of resin.

7. The process as defined in claim 6 wherein the 1-olefin contains from 6 to 10 carbons and the resulting copolymer has a molecular weight of from about 800 to 3,000.

8. The process as defined in claim 6 wherein the water-soluble copolymer is the sodium salt thereof, the 1-olefin is diisobutylene and the copolymer has a molecular weight of from about 800 to 3,000.

9. The process as defined in claim 8 wherein the water-soluble sodium salt is a copolymer of maleic anhydride and diisobutylene.

10. The process as defined in claim 9 wherein the copolymer is present in an amount varying from about 0.2 to about 5% by weight based on the weight of the resin.

11. The process as defined in claim 6 wherein the water-soluble copolymer is the ammonium salt thereof, the 1-olefin is diisobutylene and the copolymer has a molecular weight of from about 800 to 3000.

12. The process as defined in claim 11 wherein the water-soluble ammonium salt is a copolymer of maleic anhydride and diisobutylene.

13. The process as defined in claim 6 wherein the water-soluble copolymer is present in an amount varying from about 0.06% to about 8% by weight based on the weight of resin.

* * * * *

Disclaimer and Dedication 4,400,313.—*Keith Roberson,* Freeland; *Harold E. Filter,* Midland, both of Mich. PROCESS FOR WASTE ENCAPSULATION. Patent dated Aug. 23, 1983. Disclaimer and Dedication filed Dec. 18, 1989, by the assignee, The Dow Chemical Company.

Hereby disclaims and dedicates to the Public all claims of said patent.

[*Official Gazette April 10, 1990* ]